US010098508B1

(12) United States Patent
Switzer

(10) Patent No.: US 10,098,508 B1
(45) Date of Patent: Oct. 16, 2018

(54) RESETTABLE BREAKAWAY SHOWER ROD SYSTEM

(71) Applicant: Tracy Switzer, Town and Country, MO (US)

(72) Inventor: Tracy Switzer, Town and Country, MO (US)

( * ) Notice: Subject to any disclaimer, the term of this patent is extended or adjusted under 35 U.S.C. 154(b) by 275 days.

(21) Appl. No.: 14/874,869

(22) Filed: Oct. 5, 2015

Related U.S. Application Data

(60) Provisional application No. 62/062,276, filed on Oct. 10, 2014.

(51) Int. Cl.
*A47K 3/38* (2006.01)
*F16M 13/02* (2006.01)

(52) U.S. Cl.
CPC ..... *A47K 3/38* (2013.01); *F16M 13/02* (2013.01)

(58) Field of Classification Search
USPC ..... 248/251, 252; 4/576.1, 571.1
See application file for complete search history.

(56) References Cited

U.S. PATENT DOCUMENTS 5,022,104 A * 6/1991 Miller ..... A47K 3/38 160/330
5,377,948 A 1/1995 Suman
5,894,610 A 4/1999 Winter
6,263,523 B1 7/2001 Moore
6,694,543 B2 2/2004 Moore
7,512,997 B2 4/2009 Dewees
8,069,508 B2 12/2011 O'Connell
8,806,670 B2 8/2014 O'Connell
2005/0268394 A1 12/2005 Monk
2008/0289096 A1 11/2008 Patel
2010/0186161 A1 7/2010 Wong
2011/0113547 A1 * 5/2011 O'Connell ..... A47K 3/38 4/608
2011/0247133 A1 10/2011 Manga
2012/0036628 A1 2/2012 O'Connell

OTHER PUBLICATIONS http://www.grabbarsdirect.com/Anti_Suicide_Shower_Curtain_Rod_and_Flanges_s/50.htm, Sep. 25, 2014.

* cited by examiner

*Primary Examiner* — Lauren Crane
(74) *Attorney, Agent, or Firm* — Linda L Lewis; Dennis Donahue; Creativenture Law

(57) ABSTRACT

A resettable breakaway shower rod system includes a pair of mounting brackets suitable for mounting a curved shower curtain rod having ends on the wall of a shower between the brackets; the mounting brackets each includes a stationary portion, and a rotatable portion which is rotatably coupled to the stationary portion; the stationary portion and the rotatable portion have a releasable engaging device that engages the rod at a horizontal position and releases the rod to a downward breakaway position when excessive downward force is applied; both ends of the rod remain in the bracket, and the rod resets upward to a horizontal position.

8 Claims, 18 Drawing Sheets

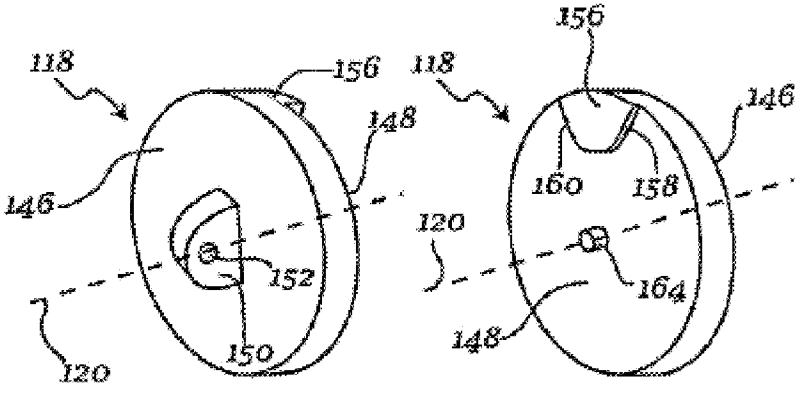
Fig. 5c
Fig. 5b
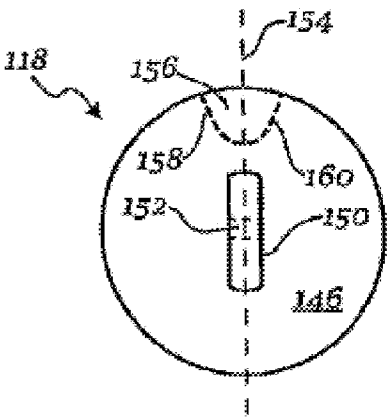
Fig. 5a

RESETTABLE BREAKAWAY SHOWER ROD SYSTEM

CROSS-REFERENCE TO RELATED APPLICATIONS

This application claims priority from U.S. Provisional Patent Application No. 62/062,276 filed Oct. 10, 2014 which is hereby incorporated by reference.

STATEMENT REGARDING FEDERALLY SPONSORED RESEARCH

Not Applicable.

APPENDIX

Not Applicable.

BACKGROUND OF THE INVENTION

Well known examples of bathroom layouts generally have a shower configuration that includes a bathtub and a hanging shower curtain. In such well known examples, the bathtub is enclosed on three sides by walls with the shower curtain substituting a fourth wall.

In an effort to increase an abode's livable space, many home designers and developers will sacrifice bathroom space to facilitate increasing the livable space. This is especially well known in condominiums, guest areas of a house or a hotel room. Condominium bathrooms are generally small such that the square footage of the livable space is increased. Moreover, the guest areas of a house, such as a guest bathroom, are typically smaller than the master bathroom and other more frequently used areas of the house to facilitate increasing the size of those more frequently used areas. As a result, such guest bathrooms generally have smaller shower areas than users would prefer.

Users of smaller shower areas may wish to increase the size of their shower area. One known example of increasing the shower area is to use a curved or angled shower rod that extends outward from above the tub area into the room. Such shower rods facilitate increasing the shower space by curving or angling a shower liner away from the shower space. As a result, the space within the shower area is increased.

However, it has been observed that the curved shower rod also stresses the mounting bracket on the wall and causes stress cracks in the walls or the shower. Excessive downward force on curved rods causes rods to bend downward. The wall mounting bracket attachment to walls loosens which further allows rods to sag. The twisting brackets damage the wall (drywall or tile or fiberglass etc.) at the attachment points. There is needed an improved mounting bracket that will keep the curved rod firmly horizontal under the normal weight of shower curtains but will release and rotate downward if excessive force is applied. Such excessive force is caused when a user pulls forcefully on the curtain or rod or hangs something heavy on the rod. Sometimes the cracking is so severe, the curved shower rod and curtain sag rather than remain horizontal.

To prevent the above-described damage or other damages, a resettable breakaway bracket assembly releases downward if a force greater than about 20 pounds is applied. In a more preferred embodiment the bracket assembly will release downward if greater than about 50 pounds is applied.

U.S. Pat. No. 8,806,670 discloses a rotatable curtain rod that rotates from a first position to a second position. The first position is horizontal curved outward, and the second position is horizontal curved inward. The only rotation possible is up and over between the two positions, as the stationary horizontal position is effected by gravity. To attempt to use this device to effect a downward breakaway position would defeat the ability of the device to hold the rod fixed horizontally. This patent fails to even mention the problem of a need for downward breakaway brackets that can be reset to the horizontal position.

BRIEF DESCRIPTION OF THE INVENTION

A resettable breakaway shower rod system is provided. The system includes a pair of mounting brackets suitable for mounting a curved shower curtain rod having ends on the wall of a shower between the brackets. The mounting brackets each includes a stationary portion, and a rotatable portion which is rotatably coupled to the stationary portion. The stationary portion and the rotatable portion have a releasable engaging device that engages the rod at a horizontal position and releases the rod to a downward breakaway position when excessive downward force is applied. The rod resets upward to a horizontal position.

A pair of resettable breakaway mounting brackets suitable for mounting a curved shower curtain rod having ends on the wall of a shower between the brackets. The mounting brackets each includes a stationary portion, and a rotatable portion which is rotatably coupled to the stationary portion. The stationary portion and the rotatable portion have a releasable engaging device that engages the rod at a horizontal position and releases the rod to a downward breakaway position when excessive downward force of greater than about 20 pounds, is applied to the horizontally mounted rod. The breakaway brackets prevent damage to the wall, wherein the curtain rod remains attached to both brackets in the breakaway position, and wherein the rod can be reset to the horizontal position from the downward breakaway position. In a preferred embodiment, the rod resets to the horizontal position by a spring action when the downward force is removed. In another preferred embodiment, the rod is reset to the horizontal position by manual manipulation when the downward force is removed.

BRIEF DESCRIPTION OF THE DRAWINGS

Advantages of embodiments of the present invention will be apparent from the following detailed description of the exemplary embodiments thereof. The following detailed description should be considered in conjunction with the accompanying Figures in which:

FIG. 5*a* is a front view of a rotatable portion that may be used with the system shown in FIG. 1;

FIG. 5*b* is a perspective front view of the rotatable portion shown in FIG. 5*a;*

FIG. 5*c* is a perspective rear view of the rotatable portion shown in FIG. 5*a;*

DETAILED DESCRIPTION OF THE INVENTION

Aspects of the present invention are disclosed in the following description and related Figures directed to specific embodiments of the invention. Those skilled in the art will recognize that alternate embodiments may be devised without departing from the spirit or the scope of the claims. Additionally, well-known elements of exemplary embodiments of the invention will not be described in detail or will be omitted so as not to obscure the relevant details of the invention.

As used herein, the word "exemplary" means "serving as an example, instance, or illustration." The embodiments described herein are not limiting, but rather are exemplary only. It should be understood that the described embodiment are not necessarily to be construed as preferred or advantageous over other embodiments. Moreover, the term "embodiments of the invention" does not require that all embodiments of the invention include the discussed feature, advantage or mode of operation.

Figure 1:
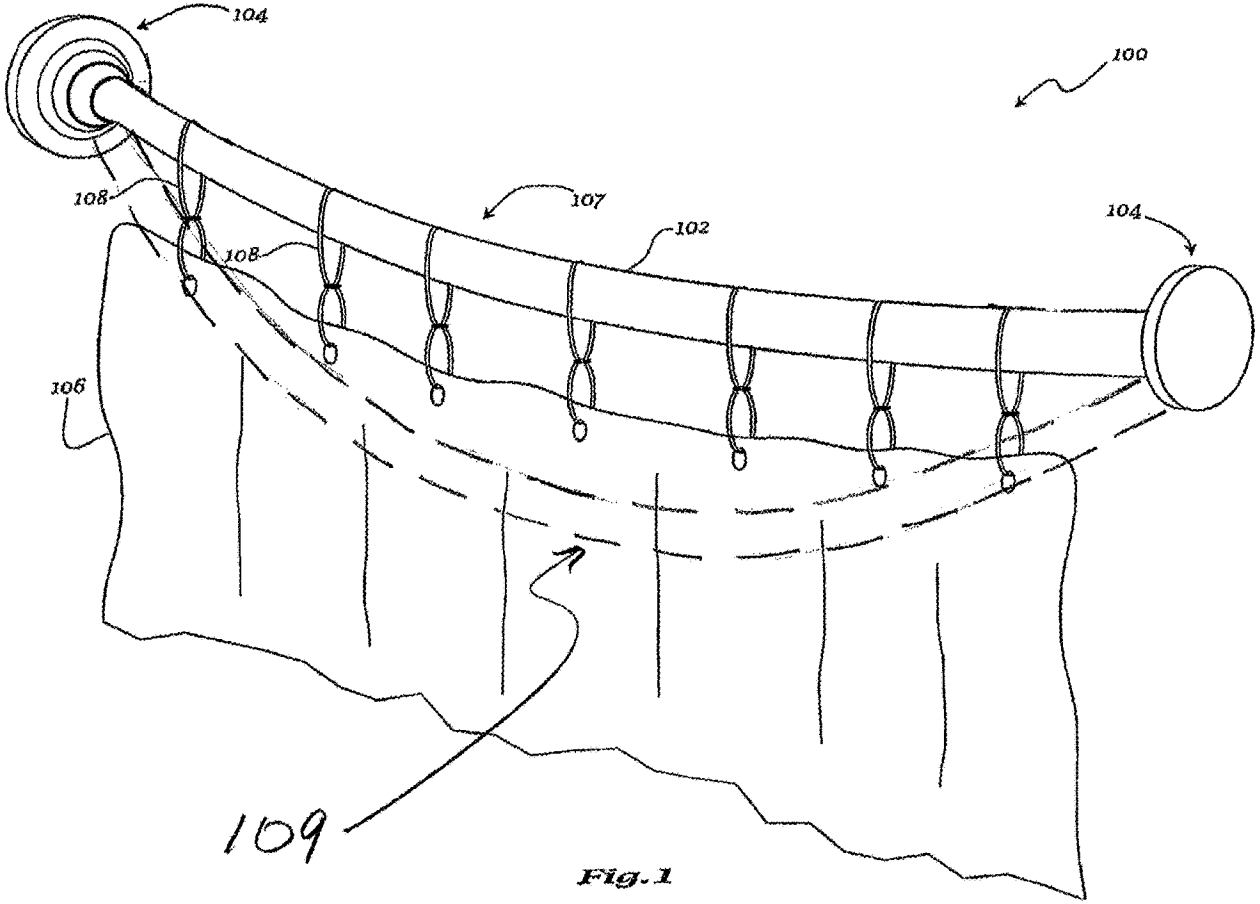
FIG. 1 is a perspective view of a resettable breakaway shower rod system.
Figure 2:
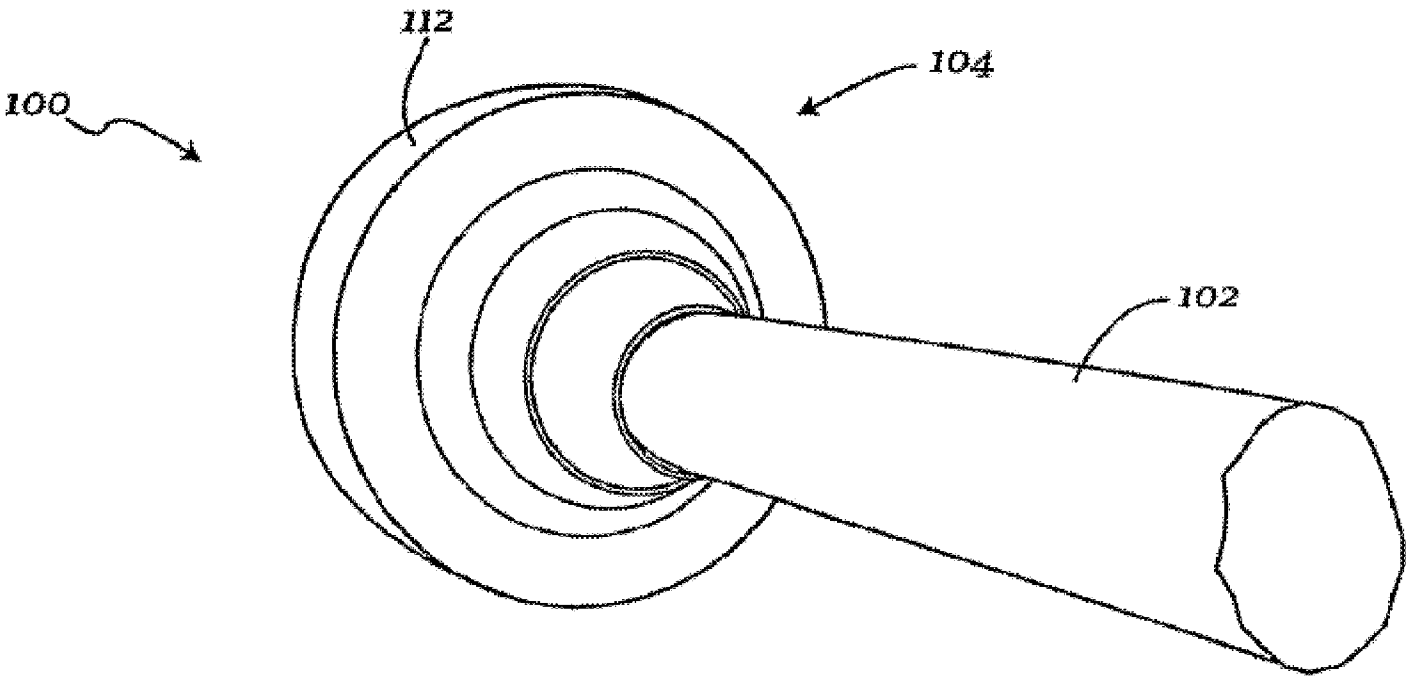
FIG. 2 is an enlarged perspective view of the resettable breakaway shower rod system shown in FIG. 1.
Figure 3C:
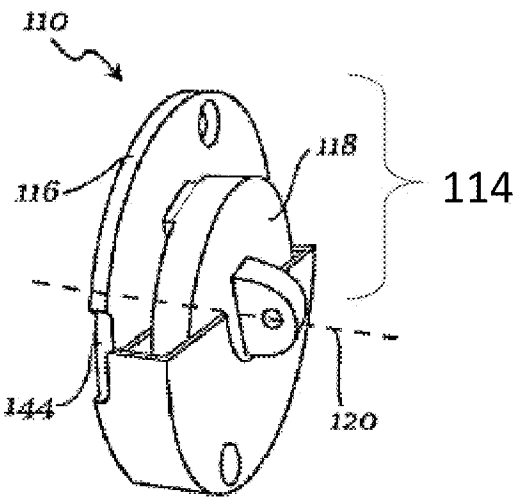
FIG. 3*c* is a perspective side view of the breakaway rotor assembly shown in FIG. 3*a;*
Figure 3B:
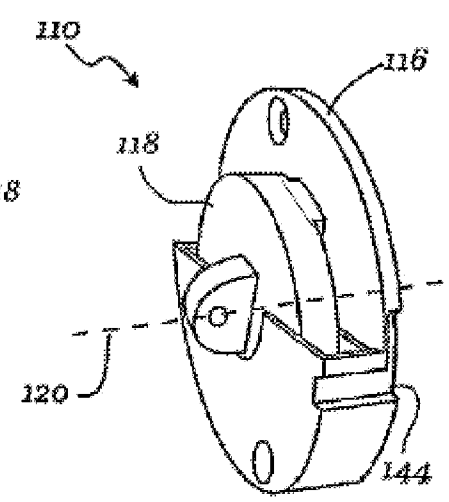
FIG. 3*b* is a perspective side view of the breakaway rotor assembly having a releasable engaging device shown in FIG. 3*a;*

FIG. 1 is a perspective view of a resettable breakaway shower rod system 100. FIG. 2 is an enlarged view of rotatable shower rod system 100. In the exemplary embodiment, system 100 may include a curved rod 102, a pair of brackets 104, a shower liner 106, and a plurality of liner fasteners 108. Each bracket 104 may include a breakaway rotor assembly 110 (shown in FIGS. 3*a*-3*c*) and a cover 112. Moreover, each bracket 104 may be coupled to a support structure, such as a shower wall (not shown). Bracket 104 may be coupled to opposite facing walls such that one bracket 104 is positioned substantially opposite from the other bracket 104, wherein curved rod 102 may extend therebetween. Curved rod 102 may be rotatably coupled to each bracket 104, as described in more detail below. Liner 106 may be slidably coupled to curved rod 102 using the plurality of liner fasteners 108. In the exemplary embodiment, an excessive downward force causes brackets 104 to release the curved rod 102 from a first horizontal position 107 to a second breakaway downward position 109, as described in more detail below.

Figure 1B:
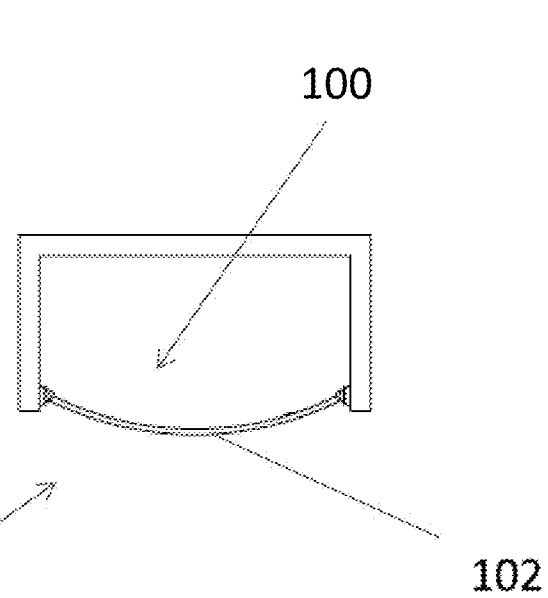
FIG. 1*b* is a top view of a resettable breakaway shower rod system in the horizontal position.
Figure 1A:
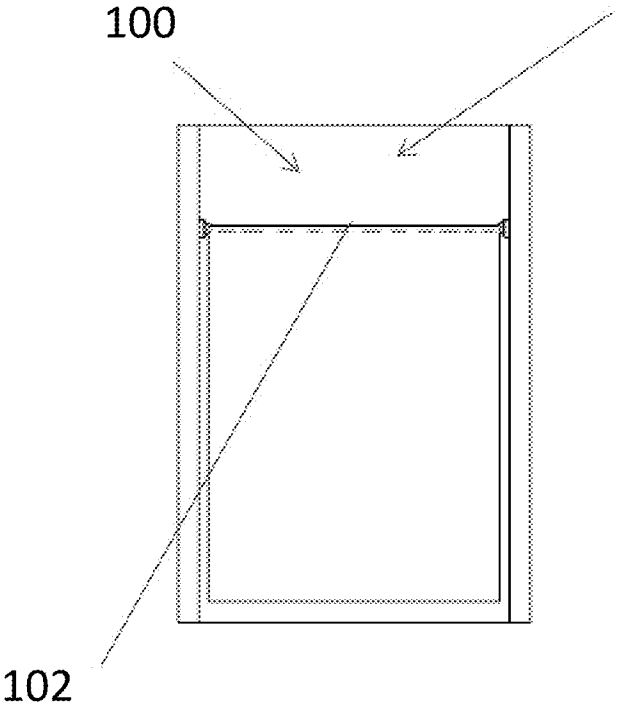
FIG. 1*a* is a front view of a rotatable resettable breakaway shower rod system in the horizontal position.
Figure 1D:
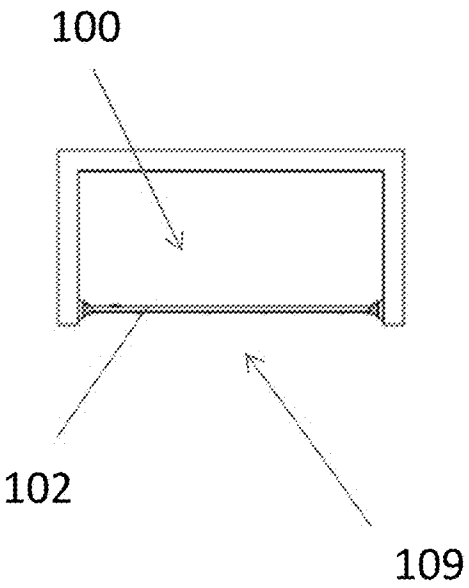
FIG. 1*d* is a front view of a resettable breakaway shower rod system in the breakaway downward position.
Figure 1C:
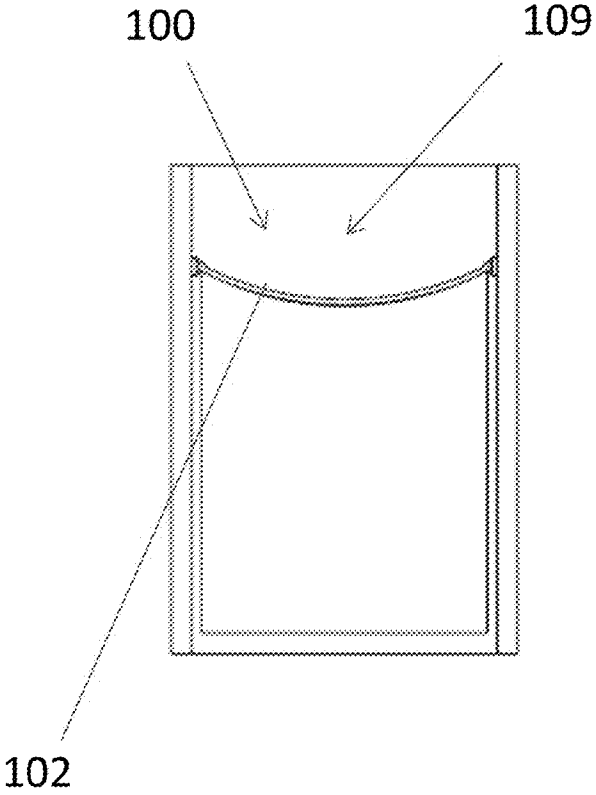
FIG. 1*c* is a front view of a resettable breakaway shower rod system in the breakaway downward position.

FIGS. 1*a*-1*d* show the resettable breakaway shower rod system mounted in a shower stall. FIGS. 1*a* and 1*b* show a front view and a top view respectively of the rod 102 in the horizontal position 107. FIGS. 1*c* and 1*d* show a front view and a top view respectively of the rod 102 in the downward breakaway position 109.

Figure 3A:
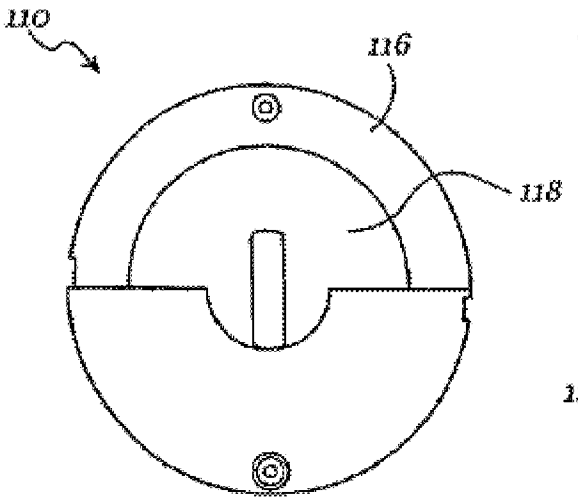
FIG. 3*a* is a front view of a breakaway rotor assembly that may be used with the system shown in FIG. 1.

A preferred embodiment is shown in FIGS. 3*a* to 11. Shown in FIG. 3*a* is a front view of breakaway rotor assembly 110 that may be used with the bracket 104, FIG. 3*b* is a perspective side view of breakaway rotor assembly 110 with a releasable engaging device 114, and FIG. 3*c* is another perspective side view of breakaway rotor assembly 110. Breakaway rotor assembly 110 may include a stationary portion 116 and a rotatable portion 118 that may be rotatably coupled thereto. As a result, rotatable portion 118 may rotate with respect to stationary portion 116 about an axis of rotation 120, as described in more detail below.

Figure 4B:
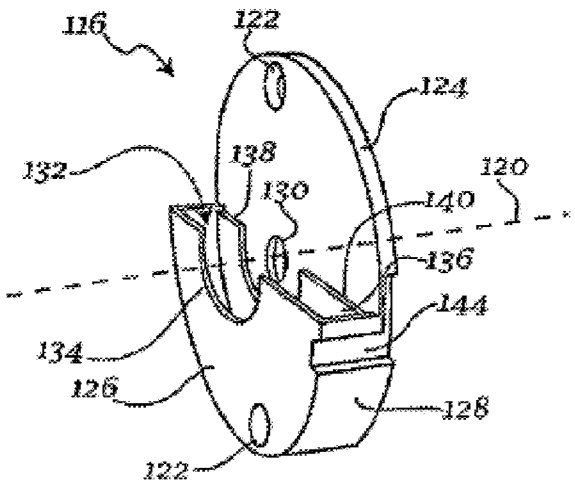
FIG. 4*b* is a perspective view of the stationary portion shown in FIG. 4*a;*
Figure 4A:
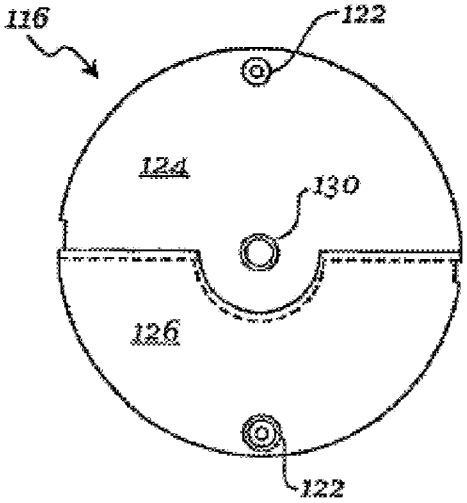
FIG. 4*a* is a front view of a stationary portion that may be used with the system shown in FIG. 1.

FIG. 4*a* is a front view of stationary portion 116 and FIG. 4*b* is a perspective side view of stationary portion 116. Stationary portion 116 may have a plurality of mounting holes 122 defined therein to enable stationary portion 116 to be coupled to the wall using a plurality of mounting fasteners (not shown). In the exemplary embodiment, stationary portion 116 may include a first plate 124, a second plate 126 and a sidewall 128 extending generally axially therebetween. First plate 124 may have a substantially circular shape and may include a center-hole 130 defined therein. Alternatively, stationary portion 116 may have a substantially oval shape and/or any polygonal shape that enables system 100 to function as described herein. Second plate 126 may have a substantially semi-circular shape and may be coupled to sidewall 128 such that a cavity 132 is defined between first plate 124, second plate 126 and sidewall 128. Cavity 132 may be configured to receive at least a portion of rotatable portion 118, as described in more detail below. Alternatively, second plate 126 may, have a substantially oval shape and/or any polygonal shape that enables system 100 to function as described herein. Second plate 126 may also have a semi-circular notch 134 defined therein, which enables rotatable portion 118 to rotate about axis of rotation 120, as described in more detail below. Alternatively, notch 134 may be any shape that enables system 100 to function as described herein. First plate 124 may also include a protrusion 136 that may extend away from first plate 124 towards second plate 126, wherein protrusion 136 may extend partially into cavity 132. Moreover, protrusion 136 may be positioned substantially opposite second plate 126.

In the exemplary embodiment, protrusion 136 may include a first contact surface 138 and a second contact surface 140 to facilitate stopping the rotation of rotatable portion 118, unless a sufficient downward force is applied to the shower rod. Stationary portion 116 may also include a plurality of locking slots 144 that facilitate coupling cover 112 to stationary portion 116.

FIG. 5*a* is a front view of rotatable portion 118, FIG. 5*b* is a perspective front view of rotatable portion 118 and FIG. 5*c* is a perspective rear view of rotatable portion 118. In the exemplary embodiment, rotatable portion 118 may be a substantially circular shaped disk that includes a first, or front surface 146 and a second, or rear surface 148. Alternatively, rotatable portion 118 may have any shape that enables system 100 to function as described herein. In the exemplary embodiment, front surface 146 may have a coupling member 150 that may be coupled thereto, wherein coupling member 150 may extend away from front surface 146. Coupling member 150 may have a substantially semi-circular shape and an aperture 152 defined therein and extending through coupling member 150. In one embodiment, coupling member 150 may be oriented such that coupling member 150 is substantially aligned with a bisection line 154 of rotatable portion 118, wherein bisection line 154 may substantially bisect rotatable portion 118 along a diameter of rotatable portion 118.

Rear surface 148 includes a spring-loaded breakaway boss 156 that may extend away from rear surface 148 and may be positioned substantially near an outer edge of rotatable portion 118. Moreover, breakaway boss 156 may be aligned with the bisection line 154 or may be from about 10 to 90 degrees from the bisection line 154. As a result, breakaway boss 156 and coupling member 150 may be oriented such that breakaway boss 156 and coupling member 150 are substantially from about 10 to 90 degrees apart. Breakaway boss 156 may include a first boss surface 158 and a second boss surface 160 that are tapered to the plate 124, facilitating the depression of the boss as sufficient downward force is applied to the curtain rod, thereby releasing the rod to move from the horizontal position 107 to the downward position 109. As described in more detail below, first and second boss surfaces 158 and 160 may contact first and second contact surfaces 138 and 140, respectively, of protrusion 136. The breakaway boss 156 and the protrusion 136 comprise the releasable engaging device 114 of this embodiment of the invention. First and second contact surfaces 138 and 140 are likewise tapered, facilitating the depression of the breakaway boss as downward force is applied to the curtain rod. Rear surface 148 may also include a rotating pin 164 that may extend generally axially away from rear surface 148 along axis of rotation 120. In one embodiment, rotating pin 164 may be positioned in the center of rotatable portion 118. Moreover, rotating pin 164 may be sized and oriented such that rotating pin 164 may be inserted within center-hole 130 of stationary portion 116 to facilitate rotatably coupling rotatable portion 118 to stationary portion 116.

Figure 5D:
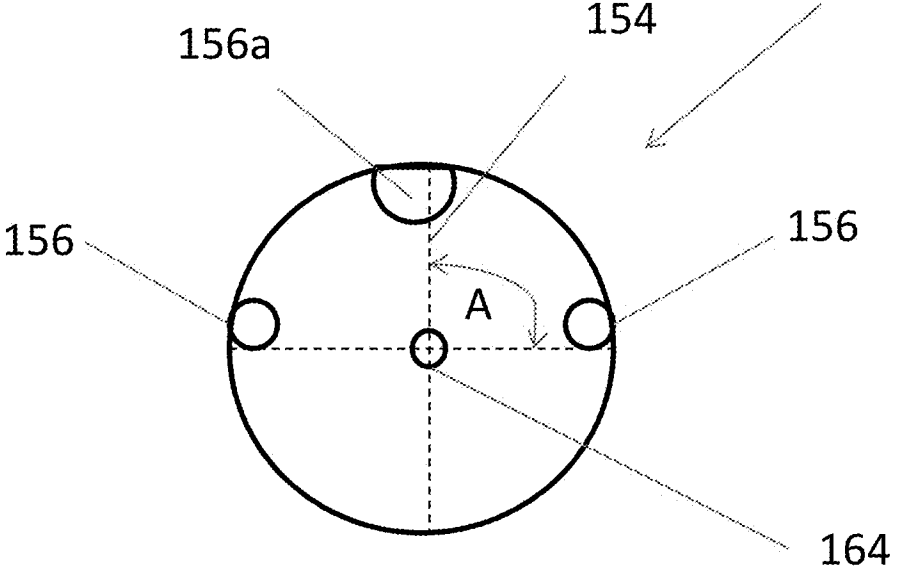
FIG. 5*d* is a rear view of a preferred embodiment of the rotatable portion shown in FIG. 5*a;*

In a preferred embodiment, as shown in FIG. 5*d*, a cam 156*a* is aligned with the bisection line 154. The two breakaway bosses 156 are from about 10 to 90 degrees separated from the bisection line 154 (see angle A). The breakaway bosses 156 allow the rotatable portion 118 to rotate from 10 to 90 degrees downward, but the 156*a* cam stops any further rotation. In this preferred embodiment, the rotatable portion 118 cannot rotate more than about 90 degrees. This is preferable, in that it is desirable to have the curved rod release and pivot downward, it is undesirable to have rod swing in a wide arc of greater than 90 degrees, possibly causing a user to loose balance and fall as the rod breaks away. After breaking away, the curved rod can be manually rotated upward (reset) from the breakaway position 109 to the horizontal position 107.

In a preferred embodiment, multiple allied breakaway bosses 156 can be arrange to breakaway sequentially, thereby slowing the movement from horizontal to downward position 109. This would be an added safety feature that would prevent a sudden and perhaps hazardous downward motion of the rod when sufficient downward force is applied.

During assembly of mounting bracket assembly 104, a portion of rotatable portion 118 may be inserted within cavity 132 such that the breakaway boss 156 is oriented generally opposite cavity 132. Moreover, rotating pin 164 may be inserted within center-hole 130 to facilitate rotatably coupling rotatable portion 118 to stationary portion 116. Semi-circular notch 134 enables rotatable portion 118, and more specifically coupling member 150, to rotate about axis of rotation 120, and more specifically rotating pin 164, without contacting second plate 126. During operation, rotatable portion 118 may rotate about rotating pin 164 such that the rotating breakaway boss 156 may contact either first contact side 138 of protrusion 136 with first boss surface 158 or second contact side 160 with second boss surface 160. As a result, protrusion 136 facilitates stopping the rotation of rotatable portion 118 at either first position 107 or second position 109.

Figure 6B:
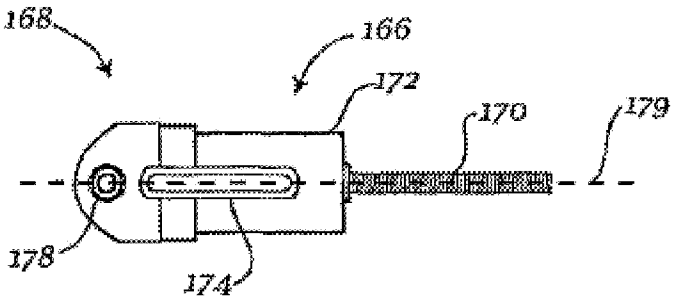
FIG. 6*b* is a top view of the rod insert shown in FIG. 6*a;*
Figure 6A:
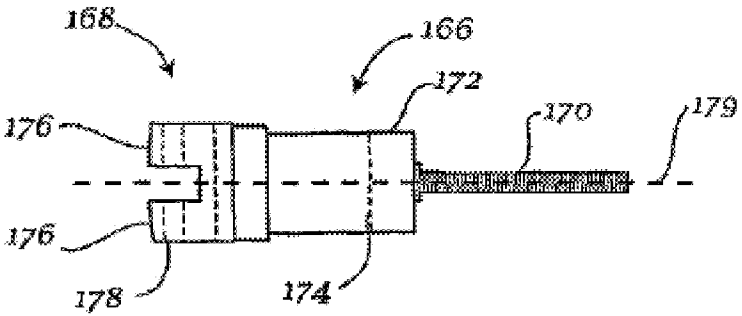
FIG. 6*a* is a side view of a rod insert that may be used with the system shown in FIG. 1.

As shown in FIGS. 6*a* and 6*b*, system 100 may include a rod insert 166 that may include a coupling end 168, a fastener 170 and a body 172 extending therebetween, wherein rod insert 166 may be hingedly coupled to coupling member 150 of rotatable portion 118. FIG. 6*a* is a side view of rod insert 166 and FIG. 6*b* is a top view of rod insert 166. In one embodiment, body 172 may have a substantially cylindrical shape and an elongated slot 174 defined within body 172. Moreover, coupling end 168 may include a pair of flanges 176 extending away therefrom, wherein flanges 176 may each have an aperture 178 defined therein. Apertures 178 of each flange 176 may be oriented such that the two apertures 178 are substantially aligned with one another. Further, fastener 170 may be a threaded member such as, but not limited to, a screw that facilitates coupling rod insert 166 to rod 102. Rod insert 166 may also have an insert centerline axis 179 that extends generally axially through the center of rod insert 166.

Figure 7:
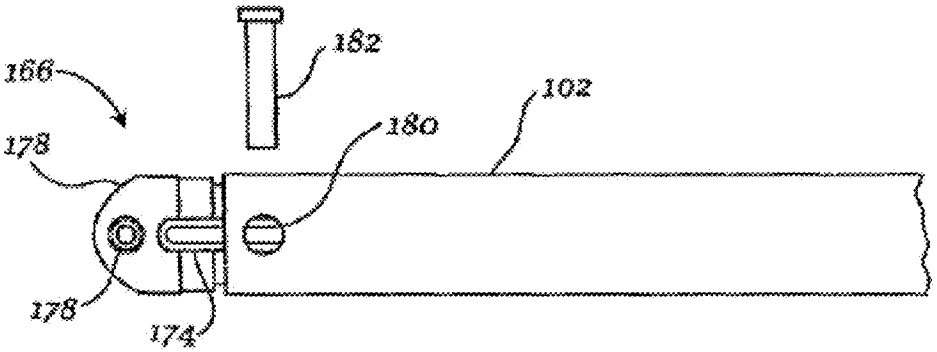
FIG. 7 is a top view of a rod and the rod insert shown in FIG. 6*b;*

As shown in FIG. 7, rod insert 166 may be inserted within curved rod 102. In the exemplary embodiment, curved rod 102 may be an elongated rod that may have a substantially cylindrical shape and may also be substantially hollow such that an internal passageway (not shown) may be defined therein. As a result, the ends of curved rod 102 may include an opening defined therein. Further, the end of curved rod 102 may have a pair of apertures 180 define therein, wherein apertures 180 may be oriented such that one aperture 180 is positioned substantially opposite of the other aperture 180. In the exemplary embodiment, rod insert 166 may be inserted within curved rod 102 such that apertures 180 may be substantially aligned with elongated slot 174 of rod insert 166. In such an embodiment, a pin 182 may be inserted through apertures 180 and through elongated slot 174 such that rod insert 166 may be slidably coupled to rod 102. As a result, rod insert 166 facilitates adjusting the length of rod 102 such that a plurality of rods having a variety of lengths may be adjusted using rod insert 166 to fit the specific dimensions of a user's bathroom. Moreover, rod insert 166 facilitates stabilizing rod 102 as rod 102 is moved between first position 107 and second position 109.

Figure 9:
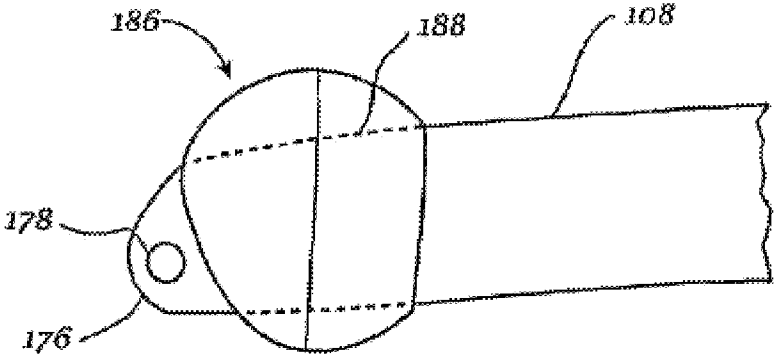
FIG. 9 is a perspective view of a rod coupled to the swivel collar that may be used with the system shown in FIG. 1.
Figure 8:
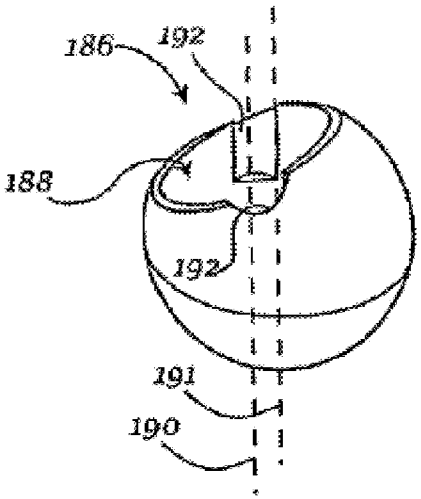
FIG. 8 is a perspective view of a swivel collar that may be used with the system shown in FIG. 1.

Turning to FIGS. 8 and 9, in the exemplary embodiment, curved rod 102 may include a swivel collar 186 coupled thereto. FIG. 8 is an enlarged perspective side view of swivel collar 186 and FIG. 9 is an enlarged perspective side view of rod 102 coupled to swivel collar 186. In the exemplary embodiment, swivel collar 186 may have a generally spherical shape and may have a passage 188 defined therethrough that extends along a passage centerline axis 190, wherein passage 188 may be sized such that rod 102 may be inserted therethrough. In one embodiment, passage centerline axis 190 may be substantially parallel to a swivel collar centerline axis 191 that may be position on a line that bisects swivel collar 186 along a diameter of swivel collar 186. Moreover, passage centerline axis 190 may be positioned such that passage centerline axis 190 is not co-axial with swivel collar centerline axis 191. As a result, passage 188 may be offset from swivel collar centerline axis 191 such that passage 188 generally does not extend through the center of swivel collar 186. Rather, in the exemplary embodiment, passage 188 may be positioned substantially close to one side of swivel collar 186. Alternatively, passage 188 may extend through the center of swivel collar 186. In the exemplary embodiment, swivel collar 186 facilitates orienting curved rod 102 at an angle with respect to axis of rotation 120 of breakaway rotor assembly 110.

In one embodiment, swivel collar 186 may include a pair of slots 192 defined within a sidewall of passage 188 to facilitate receiving a portion of insert pin 182, wherein insert pin 182 may be inserted within apertures 180 of rod 102 such that at least a portion of insert pin 182 may extend away from rod 102. As a result, slots 192 facilitate receiving the extended portion of pin 182 therein.

Figure 10:
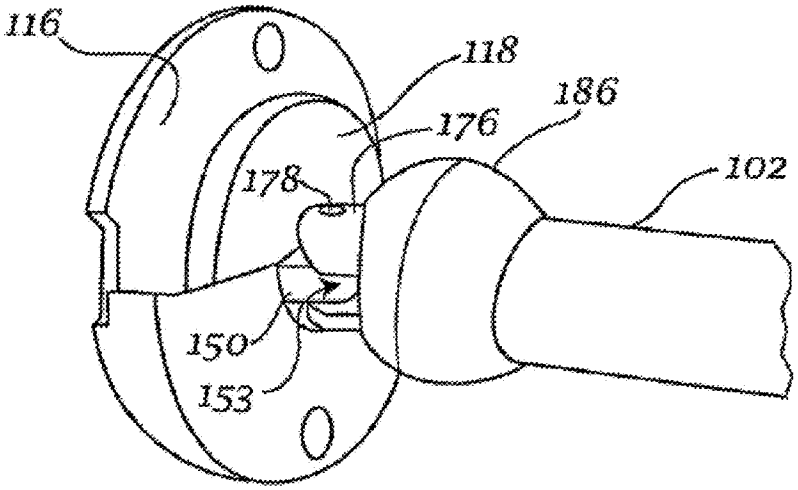
FIG. 10 is a perspective view of the rod coupled to the rotatable mount assembly that may be used with the system shown in FIG. 1.
Figure 11:
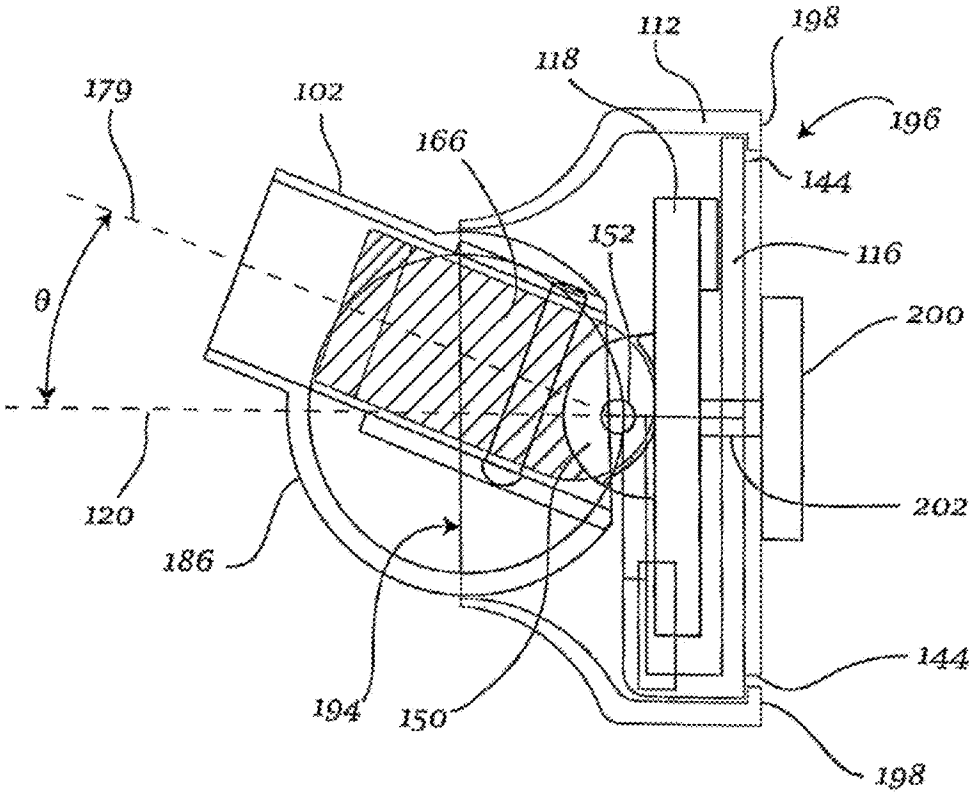
FIG. 11 is a cross-sectional side view of the rod coupled to the rotatable mount assembly shown in FIG. 10.

As shown in FIGS. 10 and 11, coupling end 168 of rod insert 166 may be coupled to coupling member 150 of rotatable portion 118 to facilitate coupling curved rod 102 to mounting bracket assembly 104. FIG. 10 is a perspective view of curved rod 102 coupled to rotatable mount assembly 110 and FIG. 11 is a cross-sectional side view of curved rod 102 coupled to mounting bracket assembly 104. Coupling end 168 may engage coupling member 150 such that coupling member 150 may be positioned between flanges 176. Moreover, apertures 178 of coupling end 168 may be substantially aligned with aperture 152 of coupling member 150 such that an insert pin (not shown in FIG. 11) may be inserted through apertures 178 and aperture 152 to facilitate hingedly coupling rod insert 166 to rotatable portion 118. When rod insert 166 and rotatable portion 118 are coupled, coupling apertures 153 may be formed between coupling member 150 and flanges 176.

As shown in FIG. 10, swivel collar 186 facilitates orienting rod insert 166, and more specifically the end of rod 102, at an angle θ with respect to axis of rotation 120. Specifically, insert centerline 179 of rod insert 166 may be oriented at angle θ with respect to axis of rotation 120 of breakaway rotor assembly 110. In one embodiment, angle θ may have a range between about 6 degrees to about 36 degrees. In another embodiment, angle θ may have a range between about 16 degrees to about 26 degrees. In yet another embodiment, angle θ may be about 21 degrees.

In the exemplary embodiment, cover 112 may be coupled to stationary portion 116 using locking slots 144. In one embodiment, cover 112 may include a first opening 194, a second opening 196 and a pair of locking flanges 198 that extend radially inward from an inner surface (not shown) of cover 112, wherein locking flanges 198 may be positioned substantially near second opening 196. Locking flanges 198 may engage locking slots 144 of stationary portion 116 to facilitate coupling cover 112 to stationary portion 116 to form rotatable mount assembly 104. In one embodiment, first opening 194 may have a diameter (not shown) that may be sized such that the diameter of first opening 192 may be configured to receive the diameter of swivel collar 186.

Figure 12:
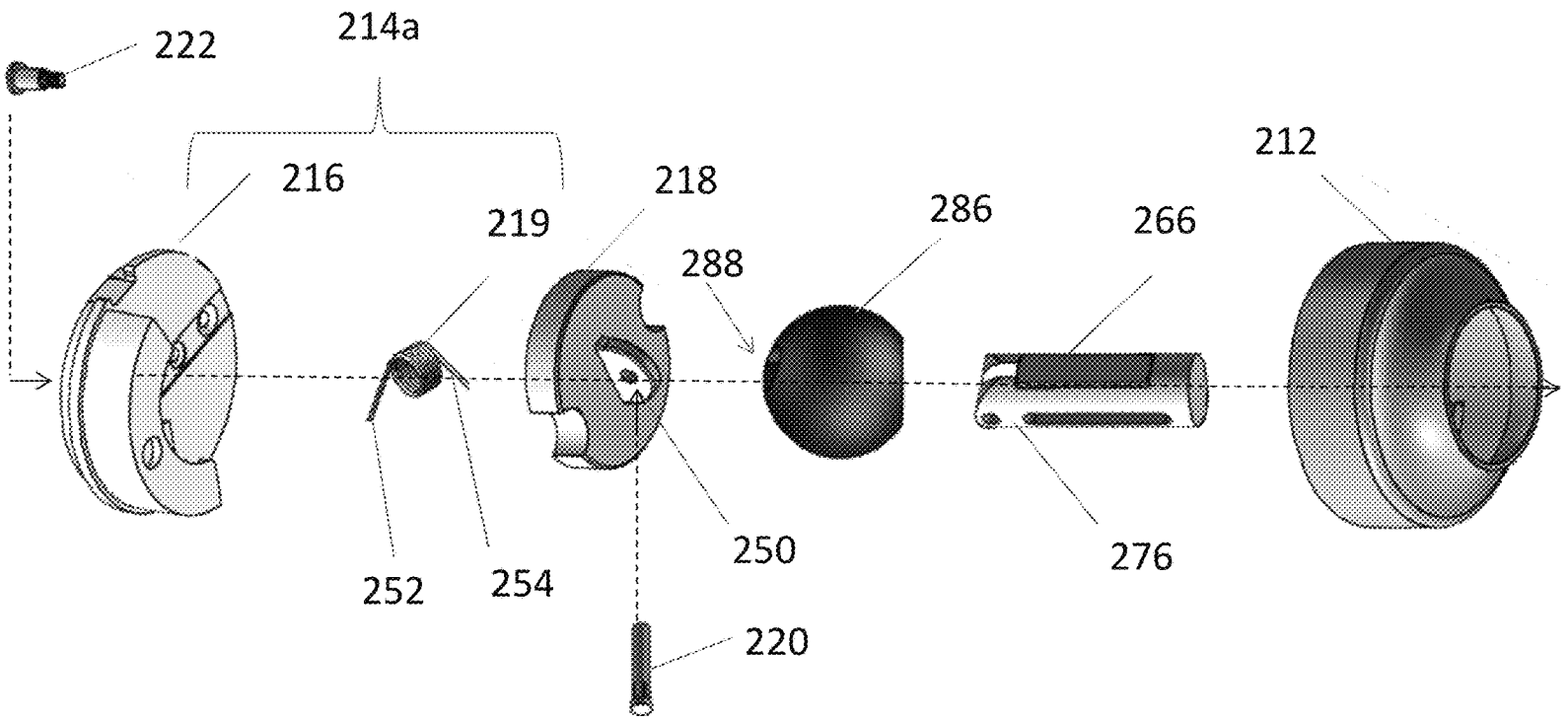
FIG. 12 is a side raised front perspective of a disassembled bracket assembly of a preferred embodiment having a releasable engaging device made of a spring mounted between the stationary portion and the rotatable portion.

FIG. 12 shows a preferred embodiment wherein a spring 219 is positioned between a rotatable portion 218 that does not have or a breakaway boss, and the stationary portion 216. The spring 219 has an anchor portion 252 and a moveable portion 254. The spring can be attached at the anchor portion 252 to either the rotatable portion 218 or the stationary portion 216. Moving in opposition, the other portion of the spring can then be attached by the moveable portion 254 to either the rotatable portion 218 or the stationary portion 216. The rotatable portion 218, the stationary portion, and the spring 219 are releasably engaged to hold the rod 102 in the horizontal position until excessive downward force is applied to the rod 102. The attachment to the rotatable portion 218, the attachment to the stationary portion, and the spring 219 comprise the releasable engaging device 214*a* of the present invention. The rod 102 (not shown) then rotates downward from the horizontal position 107 (the untensioned state) to the downward breakaway position 109 (the tensioned state). When the excessive downward force is released, and the tension removed from the spring 219, it rotates back to the horizontal position essentially unassisted. A torsion spring is shown in FIG. 12, but other types of springs, such as a tension spring or a clock spring is also useful for this invention.

As shown in FIG. 12, the flanges 276 of rod insert 266 may be coupled to coupling member 250 of rotatable portion 218. Moreover, apertures of the flanges 276 may be substantially aligned with aperture the aperture of coupling member 250 such that an insert pin 220 may be inserted through the apertures to facilitate hingedly coupling rod insert 266 to rotatable portion 218. The stationary portion 216 and the spring 219 are fastened to the rotatable portion 218 with a screw 222 that acts as a rotating pin.

Figure 13:
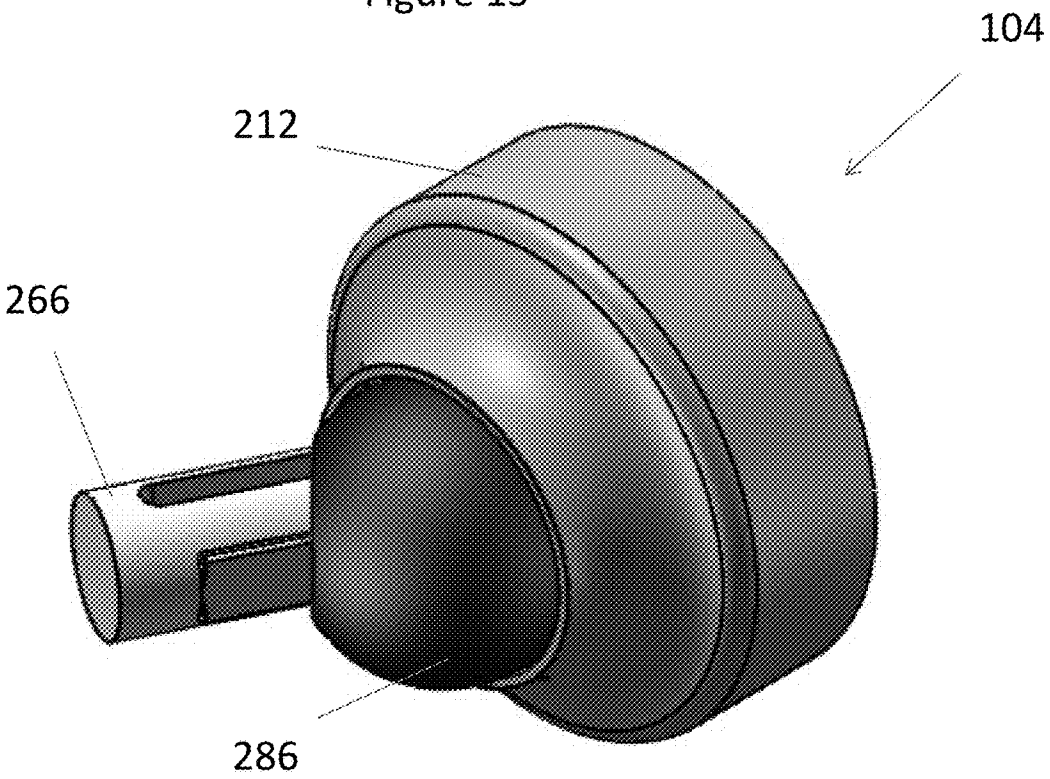
FIG. 13 is a side front raised perspective of the assembled bracket assembly of FIG. 12
Figure 14:
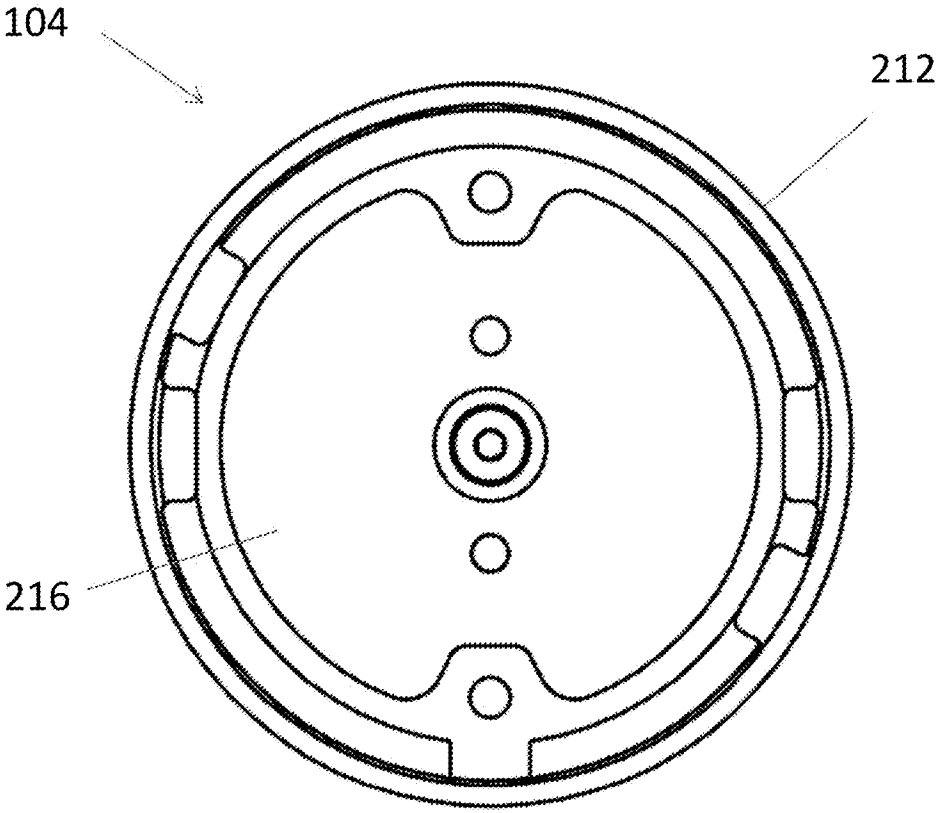
FIG. 14 is a rear perspective of the assembled bracket of FIG. 13.

Swivel collar 286 has a passage through 288 to accommodate the rod insert 266. This facilitates orienting rod insert 266. In the exemplary embodiment, cover 212 may be coupled to stationary portion 216 using methods well known in the art, such as locking slots. The assembled bracket assembly is shown in FIG. 13, and the back of the assembly is shown in FIG. 14.

Figure 15:
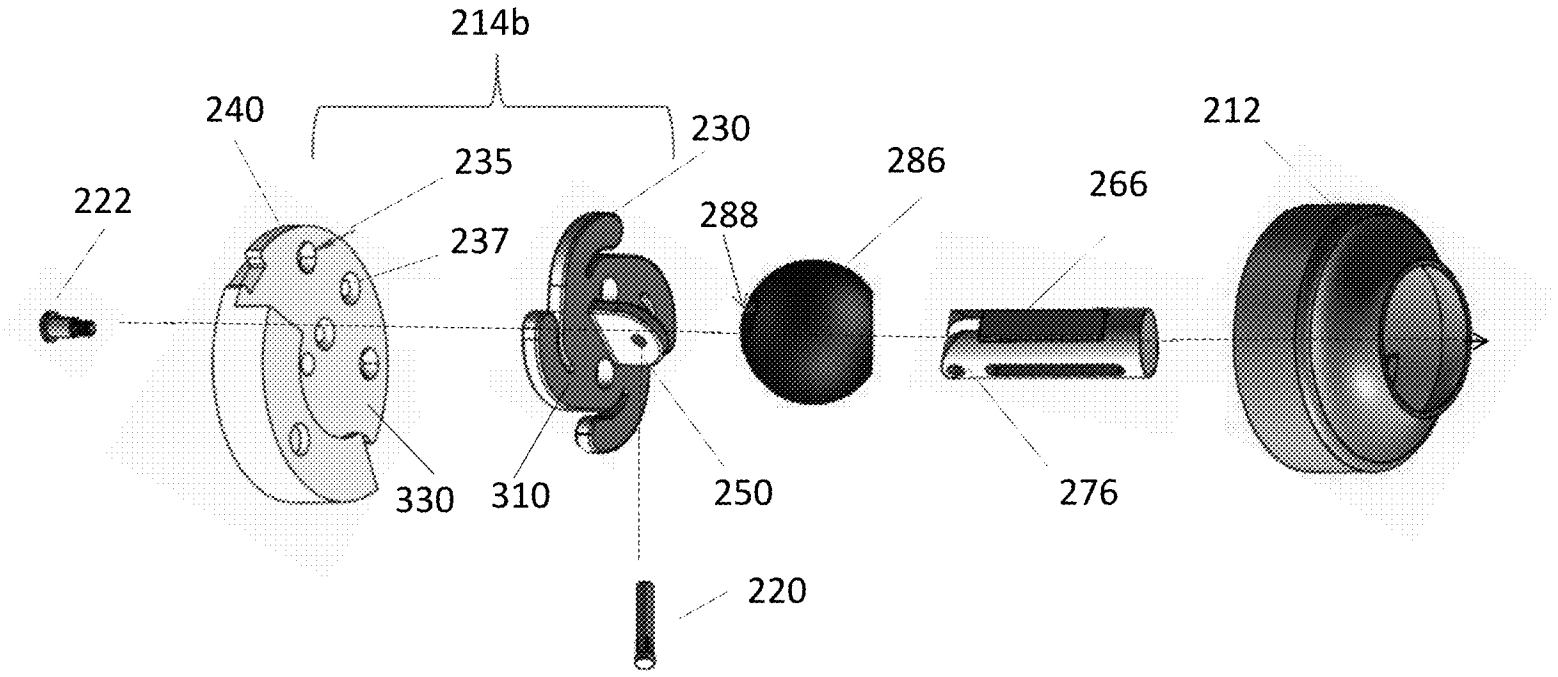
FIG. 15 is a side raised front perspective of a disassembled bracket assembly of a preferred embodiment having a releasable engaging device made of a rotatable detent rotatably engaged with the stationary detent.
Figure 16:
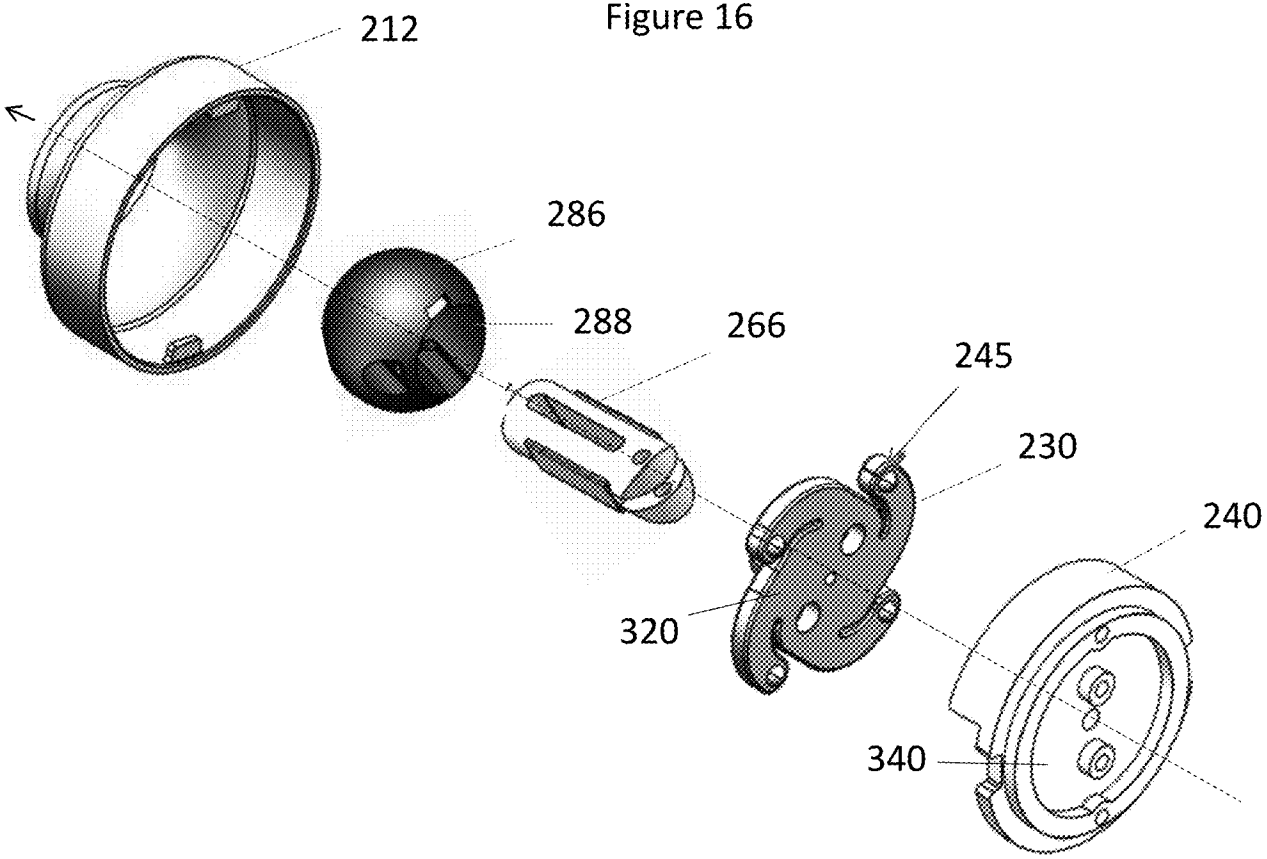
FIG. 16 is a side raised rear perspective of the disassembled bracket assembly of a preferred embodiment having a releasable engaging device made of a rotatable detent rotatably engaged with the stationary detent of FIG. 15.

FIGS. 15 and 16 show a preferred embodiment, wherein a rotatable detent 230 having one or more detent bosses 245 located at its perimeter is rotatably coupled to a stationary detent 240 that has two or more detent pockets 235, 237. As excessive downward force is applied to the rod 102, the detent boss 245 moves from a first detent pocket 235 to a lower detent pocket 237, and the rod 102 (not shown) rotates from the horizontal position 107 to the downward breakaway position 109. The detent bosses 245 and the detent pockets 235 comprise the releasable engaging device 214*b* of the present invention. The first detent pocket is positioned to hold the rod 102 in the horizontal position. The second detent pocket is positioned to allow the rod 102 to move to the downward breakaway position. When the excessive downward force is released from the rod, it can be moved back to the horizontal position. The stationary detent has a first stationary surface 330 and a second stationary surface 340. The rotatable detent has a first rotatable surface 310 and a second rotatable surface 320.

In another preferred embodiment, the rotatable detent 230 has the detent pockets 235, 237 and the stationary detent 240 has the detent bosses 245.

As can be readily seen by one skilled in the art, numerous approaches can be taken to provide the release feature desired in the present invention.

The embodiments were chosen and described to best explain the principles of the invention and its practical application to persons who are skilled in the art. As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A resettable breakaway shower rod system comprising a pair of mounting brackets suitable for coupling to a wall, said pair of mounting brackets comprising:

a stationary portion;

a rotatable portion rotatably coupled to said stationary portion, said rotatable portion rotatable to a horizontal position and a downward breakaway position and back to the horizontal position about an axis of rotation;

wherein the rotatable portion further comprises a first rotatable surface comprising a coupling member, said coupling member comprising at least one aperture defined therein, and a second rotatable surface comprising at least two detent bosses;

wherein the at least two detent bosses are located at the perimeter of the rotatable portion;

wherein the stationary portion has a first stationary surface and a second stationary surface, the first stationary surface having at least two detent pockets for engaging with the at least two detent bosses, and the second stationary surface is suitable for coupling to a wall;

wherein a rotating pin rotatably couples the stationary portion and the rotatable portion;

a cover coupled to said stationary portion; and a curved rod extending between said pair of mounting brackets.

2. The resettable breakaway shower rod system of claim 1, wherein the system has at least three detent bosses and at least three detent pockets.

3. A resettable breakaway shower rod system comprising a pair of mounting brackets suitable for coupling to a wall, said pair of mounting brackets comprising:

a stationary portion;

a rotatable portion rotatably coupled to said stationary portion, said rotatable portion rotatable to a horizontal position and a downward breakaway position and back to the horizontal position about an axis of rotation;

wherein the rotatable portion further comprises a first rotatable surface comprising a coupling member extending away therefrom, said coupling member comprising at least one aperture defined therein, and a second rotatable surface comprising at least two detent pockets;

wherein the at least two detent pockets are located at the perimeter of the rotatable portion;

wherein the stationary portion has a first stationary surface and a second stationary surface, the first stationary surface having at least two detent bosses for engaging with the at least two detent pockets, and the second stationary surface is suitable for coupling to a wall;

wherein a rotating pin rotatably couples the stationary portion and the rotatable portion;

a cover coupled to said stationary portion; and a curved rod extending between said pair of mounting brackets.

4. The resettable breakaway shower rod system of claim 3, wherein the system has at least three detent bosses and at least three detent pockets.

5. A releasable engaging device comprising a stationary portion;

a rotatable portion rotatably coupled to said stationary portion, said rotatable portion rotatable to a horizontal position and a breakaway position and back to the horizontal position about an axis of rotation;

wherein the rotatable portion further comprises a first rotatable surface comprising a coupling member, said coupling member comprising at least one aperture defined therein, and a second rotatable surface comprising at least two detent bosses;

wherein the at least two detent bosses are located at the perimeter of the rotatable portion;

wherein the stationary portion has a first stationary surface and a second stationary surface, the first stationary surface having at least two detent pockets for engaging with the at least two detent bosses, and the second stationary surface is suitable for coupling to a wall; and wherein a rotating pin rotatably couples the stationary portion and the rotatable portion.

6. The releaseable engaging device of claim 5, wherein the device has at least three detent bosses and at least three detent pockets.

7. A releasable engaging device comprising a stationary portion;

a rotatable portion rotatably coupled to said stationary portion, said rotatable portion rotatable to a horizontal position and a breakaway position and back to the horizontal position about an axis of rotation;

wherein the rotatable portion further comprises a first rotatable surface comprising a coupling member, said coupling member comprising at least one aperture defined therein, and a second rotatable surface comprising at least two detent pockets;

wherein the at least two detent pockets are located at the perimeter of the rotatable portion;

wherein the stationary portion has a first stationary surface and a second stationary surface, the first stationary surface having at least two detent bosses for engaging with the at least two detent pockets, and the second stationary surface is suitable for coupling to a wall; and wherein a rotating pin rotatably couples the stationary portion and the rotatable portion.

8. The releaseable engaging device of claim 7, wherein the device has at least three detent bosses and at least three detent pockets.

* * * * *